US009945045B2

(12) United States Patent
Chandrasekhar et al.

(10) Patent No.: US 9,945,045 B2
(45) Date of Patent: Apr. 17, 2018

(54) ELECTROCHEMICAL DEPOSITION APPARATUS AND METHODS OF USING THE SAME

(71) Applicant: Ashwin-Ushas Corporation, Inc., Holmdel, NJ (US)

(72) Inventors: Prasanna Chandrasekhar, Holmdel, NJ (US); Brian J. Zay, Hamilton, NJ (US); Richard Modes, Sr., Hopatcong, NJ (US); Anthony LaRosa, Rockaway, NJ (US); Kyle Hobin, Montclair, NJ (US)

(73) Assignee: Ashwin-Ushas Corporation, Inc., Holmdel, NJ (US)

( * ) Notice: Subject to any disclaimer, the term of this patent is extended or adjusted under 35 U.S.C. 154(b) by 41 days.

(21) Appl. No.: 14/956,493

(22) Filed: Dec. 2, 2015

(65) Prior Publication Data

US 2017/0159201 A1 Jun. 8, 2017

(51) Int. Cl.

| | |
|---|---|
| ***C25D 9/02*** | (2006.01) |
| ***C25D 17/10*** | (2006.01) |
| ***C25D 17/12*** | (2006.01) |
| ***C25D 17/00*** | (2006.01) |
| ***C25D 21/12*** | (2006.01) |

(52) U.S. Cl.

CPC ..... *C25D 17/005* (2013.01); *C25D 9/02* (2013.01); *C25D 17/10* (2013.01); *C25D 17/12* (2013.01); *C25D 21/12* (2013.01)

(58) Field of Classification Search

CPC ..... C25D 9/02; C25D 7/12–7/126; C25B 9/20–9/206

See application file for complete search history.

(56) References Cited

U.S. PATENT DOCUMENTS

| | | | | |
|---|---|---|---|---|
| 2,425,359 A * | 8/1947 | Zavarella | C25D 5/16 204/272 |
| 4,559,122 A | 12/1985 | Folco et al. | |
| 4,665,874 A | 5/1987 | Kawanabe et al. | |
| 5,131,996 A * | 7/1992 | Birkle | C23G 3/00 198/603 |
| 5,182,585 A | 1/1993 | Stoner | |
| 5,441,629 A | 8/1995 | Kosaki | |
| 5,992,996 A | 11/1999 | Sawyer | |
| 6,033,592 A | 3/2000 | Chandrasekhar | |
| 6,063,253 A | 5/2000 | Shreve et al. | |

(Continued)

FOREIGN PATENT DOCUMENTS

| | | |
|---|---|---|
| CN | 101939399 A | 1/2011 |
| CN | 202705536 U | 1/2013 |

(Continued)

OTHER PUBLICATIONS

K. Krishnamoorthy et al. Rational design of an electrochromic polymer with high contrast in the visible region: dibenzyl substituted poly(3,4-propylenedioxythiophene). Journal Materials Chemistry, vol. 11, issue 12. Oct. 12, 2001.

(Continued)

*Primary Examiner* — Bryan D. Ripa
*Assistant Examiner* — Ho-Sung Chung
(74) *Attorney, Agent, or Firm* — Morgan, Lewis & Bockius LLP

(57) ABSTRACT

An electrochemical deposition apparatus and methods of using the same are provided herein.

22 Claims, 8 Drawing Sheets

(56) References Cited

U.S. PATENT DOCUMENTS

| | | | | |
|---|---|---|---|---|
| 6,080,290 | A | 6/2000 | Stuart et al. | |
| 6,083,376 | A | 7/2000 | Akram et al. | |
| 6,115,177 | A | 9/2000 | Vossler | |
| 6,132,583 | A | 10/2000 | Stone | |
| 6,261,425 | B1 | 7/2001 | Huang et al. | |
| 6,267,853 | B1 | 7/2001 | Dordi et al. | |
| 6,270,647 | B1 | 8/2001 | Graham et al. | |
| 6,294,060 | B1 | 9/2001 | Webb et al. | |
| 6,299,751 | B1 | 10/2001 | Kaufman et al. | |
| 6,299,753 | B1 | 10/2001 | Chao et al. | |
| 6,402,924 | B1 | 6/2002 | Martin et al. | |
| 6,547,945 | B2 | 4/2003 | Shallow et al. | |
| 6,551,484 | B2 | 4/2003 | Hey et al. | |
| 6,607,652 | B2 | 8/2003 | Webb et al. | |
| 6,837,978 | B1 | 1/2005 | Hey et al. | |
| 7,118,658 | B2 * | 10/2006 | Woodruff | C25D 17/06 204/224 R |
| 7,223,323 | B2 | 5/2007 | Yang et al. | |
| 7,247,222 | B2 | 7/2007 | Yang et al. | |
| RE40,215 | E | 4/2008 | Landau | |
| 7,384,522 | B2 | 6/2008 | Marszal et al. | |
| 7,427,338 | B2 | 9/2008 | Dordi et al. | |
| 7,449,098 | B1 | 11/2008 | Mayer et al. | |
| 7,704,352 | B2 | 4/2010 | Lopatin et al. | |
| 7,828,944 | B2 | 11/2010 | Nagashima et al. | |
| 8,236,151 | B1 * | 8/2012 | Olson | C25D 17/005 204/286.1 |
| 8,241,228 | B1 | 8/2012 | Cohen et al. | |
| 8,496,790 | B2 | 7/2013 | Wilson et al. | |
| 8,551,315 | B2 | 10/2013 | Cohen | |
| 8,603,316 | B2 | 12/2013 | Cohen | |
| 8,932,443 | B2 | 1/2015 | Sto. Domingo | |
| 2002/0157959 | A1 | 10/2002 | Kronenberg et al. | |
| 2004/0003894 | A1 * | 1/2004 | Hsu | C25D 5/22 156/345.12 |
| 2004/0256222 | A1 | 12/2004 | Griego et al. | |
| 2005/0189220 | A1 | 9/2005 | Yamamoto et al. | |
| 2006/0070883 | A1 | 4/2006 | Bejan et al. | |
| 2007/0215457 | A1 | 9/2007 | Glassman | |
| 2007/0238265 | A1 * | 10/2007 | Kurashina | H01L 21/2885 438/470 |
| 2008/0245471 | A1 | 10/2008 | Goad | |
| 2009/0213282 | A1 | 8/2009 | Burlingame et al. | |
| 2010/0059385 | A1 * | 3/2010 | Li | C25D 5/10 205/84 |
| 2010/0181189 | A1 * | 7/2010 | Suarez | C25B 9/08 204/263 |
| 2012/0175246 | A1 * | 7/2012 | Buttaci | C25D 17/10 204/228.1 |
| 2012/0247967 | A1 * | 10/2012 | James | C25D 5/026 205/136 |
| 2012/0292179 | A1 * | 11/2012 | Wilson | C25D 5/08 204/198 |
| 2013/0112564 | A1 * | 5/2013 | Kleiman-Shwarsctein | C25D 3/56 205/104 |
| 2013/0186852 | A1 | 7/2013 | Dietrich et al. | |
| 2014/0097088 | A1 | 4/2014 | Stowell et al. | |
| 2014/0284216 | A1 | 9/2014 | MacNeil | |
| 2014/0353159 | A1 | 12/2014 | Majoros et al. | |
| 2015/0129418 | A1 | 5/2015 | Keigler et al. | |

FOREIGN PATENT DOCUMENTS

| | | | |
|---|---|---|---|
| CN | 203256361 | U | 10/2013 |
| CN | 103436946 | A | 12/2013 |
| CN | 103498134 | A | 1/2014 |
| CN | 203530467 | U | 4/2014 |
| EP | 0915189 | A2 | 5/1999 |
| EP | 0989209 | A2 | 3/2000 |
| EP | 0915189 | B1 | 10/2003 |
| EP | 1533400 | A1 | 5/2005 |
| WO | 9845504 | A1 | 4/1998 |
| WO | 0204715 | A2 | 1/2002 |
| WO | 2004001100 | A1 | 12/2003 |
| WO | 2009114965 | A1 | 9/2009 |
| WO | 2012158966 | A2 | 11/2012 |
| WO | 2015014292 | A1 | 2/2015 |

OTHER PUBLICATIONS

Javier Padilla, Venkataramanan et al. High contrast solid state electrochromic devices from substituted 3,4-propylenedioxythiophenes using the dual conjugated polymer approach. Synthetic Metals, Issue 157, Apr. 23, 2007.

International Search Report dated Mar. 9, 2017 for PCT/US2016/064225.

Written Opinion of the International Searching Authority dated Mar. 8, 2017 for PCT/US2016/064225.

* cited by examiner

ELECTROCHEMICAL DEPOSITION APPARATUS AND METHODS OF USING THE SAME

FIELD OF THE INVENTION

The present invention relates generally to devices and methods for the electrochemical deposition of coating materials and more particularly, but not exclusively, to devices and methods for the electrochemical deposition of electrochromic polymers for the preparation of electrochromic lenses.

BACKGROUND OF THE INVENTION

Electroplating systems are commonly used to electroplate or electrochemically deposit various materials onto conductive substrates. Although many types of electroplating systems are known, a variety of problems exist in the field, as briefly enumerated below, which are currently in need of solutions.

Certain problems present in the field include an inability to make effective electrical contact with substrates while, at the same time, insulating points of electrical contact from a deposition or plating solution and maintaining a liquid seal in the deposition tank, such that there is no leakage. This may be a problem when using substrates with lower conductivity.

Moreover, problems may emanate from the resistance increase (or conductivity drop) from the point of electrical contact to the interior of the substrate, especially acute for substrates with lower conductivity. Due to this, the voltage applied at the point of electrical contact may not be the same as that seen at the interior of the substrate, leading to non-uniform deposits, with, in many cases, a greater thickness of the deposit nearer the point of electric contact than that in the interior of the substrate.

The field also includes systems that lack an adequate means of holding electrodes and substrates firmly and maintaining precise and, preferably, minimal distance between the working electrode (the substrate upon which a material of interest may be deposited), the counter electrode, and the reference electrode (if used), for effective, diffusion-limited control as well as high efficiency of the electrochemical deposition.

Issues in the field also include the maintenance of a larger area for the counter electrode as compared to the working electrode, so that the limiting electrode processes for the deposition do not occur at the counter electrode.

Additional limitations in the field include: (1) use of pumps and elaborate circulation systems which limit efficiency; (2) a lack of a hermetic seal of the deposition apparatus or plating tank such that there is minimal solvent loss, which is especially pertinent when volatile solvents are used; (3) a lack of accurate control of the applied potential at the working electrode; (4) a lack of accurate control of the total charge passed during electrochemical deposition, so that thickness, morphology, and other features of the deposit may be well controlled; and (5) a lack of amenability to automated or semi-automated electrochemical deposition.

The present invention answers these and other needs in the field and provides an electroplating device and methods of using the same.

SUMMARY OF THE INVENTION

Generally, the present invention provides an apparatus for the electrochemical deposition (e.g., electrochemical polymerization, electrochemical plating, or electroplating) of a coating material from a deposition solution. In a particular embodiment, the present invention pertains to an electrochemical deposition apparatus configured to deposit monomers of electrochromic conducting polymers at a substrate.

In a first aspect, the present invention provides an electrochemical deposition apparatus that may include a support structure. The apparatus may include a first electrode mount connected to the support structure and a second electrode mount connected to the support structure. The apparatus may include a deposition chamber frame that may be configured to receive a deposition solution. The deposition chamber frame may be disposed proximate to the first and second electrode mounts. Moreover, the deposition chamber frame may include a first aperture portion and a second aperture portion. The first aperture portion may be configured to face the first electrode mount and may include a first aperture and a conductive perimeter element. The second aperture portion may be configured to face the second electrode mount and may include a second aperture.

In certain embodiments of the apparatus of the invention, the apparatus may include at least one biasing member that may connect the support structure to at least one of the first electrode mount and the second electrode mount. The at least one biasing member may include a spring, a clamp, an actuator, or a combination thereof. For example, the at least one biasing member may connect the support structure to the first electrode mount and may include a pneumatic actuator.

Regarding certain features of the deposition chamber frame, the second aperture may be larger than the first aperture.

The apparatus of the invention may include a first electrode connected to the first electrode mount. The first electrode may be configured to be disposed in electrical communication with the conductive perimeter element at the first aperture portion. Moreover, the first electrode may include a material selected from the group consisting of indium-tin-oxide (ITO), poly (ethylene terephthalate) (PET), glass, and a combination thereof (e.g., a conductive plastic ITO/PET). Additionally, the first electrode may include or be provided as a conductive sheet (e.g., a conductive sheet that includes one or more of ITO, PET, and glass).

Regarding the conductive perimeter element, the element may include at least one electrode contact. The at least one electrode contact may include a plurality of electrode contacts. Alternatively, the at least one electrode contact be a continuous electrode contact. In certain embodiments, the conductive perimeter element may include a plurality of contact pins (e.g., spring-loaded contact pins).

The apparatus of the invention may include a second electrode connected to the second electrode mount. The second electrode may include graphite. For example, the second electrode may include a conductive sheet composed of graphite.

In another embodiment, the apparatus of the invention may include first and second electrodes that may be connected to the first and second electrode mounts, respectively, wherein the first electrode includes a working electrode and the second electrode includes a counter electrode.

The apparatus of the invention may include a reference electrode that may be disposed within the deposition chamber frame. The reference electrode of the invention may be a Ag/AgCl reference electrode or a Pt or Au wire quasi-reference electrode.

In another aspect, the present invention may include an electrochemical deposition apparatus that includes an electroplating vessel. The apparatus may include a support structure and a frame that may be disposed with the support structure. The frame may include a cavity that may be configured to receive a deposition solution and may include: (1) a first aperture portion having a first aperture; and (2) a second aperture portion having a second aperture, wherein the second aperture may be larger than the first aperture. Moreover, the apparatus may include a working electrode that may be disposed proximate to the first aperture and/or a counter electrode that may be disposed proximate to the second aperture. The frame, the working electrode, and the counter electrode may be combined to form the electroplating vessel of the apparatus.

Regarding the cavity of the frame, the cavity may include a telescoped cavity, a tapered cavity, or a combination thereof. Additionally, the second aperture may be at least twice as large as the first aperture. Indeed, the second aperture may be three times as large as the first aperture.

In certain embodiments, the apparatus of the invention may include a plurality of guides that are configured to align the frame, the working electrode, and/or the counter electrode.

In certain specific aspects of the devices of the invention, a counter electrode and a working electrode may be provided that may be positioned to act as two walls of a deposition chamber. The counter electrode and working electrode may be placed against a deposition frame portion which, in combination with the two electrodes, may act as the deposition chamber, vessel, or tank. Electrical contact may be made to the counter electrode along its outside perimeter, which may be sealed off from the deposition solution. The deposition solution may include a coating material. Electrical contact may be made to the working electrode along a portion of the working electrode through the use of a conductive perimeter element (e.g., spring-loaded contacts) that may also be sealed off from the deposition solution. The deposition frame portion, which may be abutted by the working and counter electrodes, may be tapered or telescoped such that the counter electrode area is larger than the working electrode area. For example, the counter electrode area may be significantly larger (e.g., at least two times larger) than the working electrode area so that the limiting electrode processes do not occur at the counter electrode.

A reference electrode may also be disposed between the working and counter electrodes. Preferably, the reference electrode is placed closer to the working electrode, rather than the counter electrode, such that the applied potential at the working electrode is more accurately regulated. Prior to filling or charging of the deposition vessel, the vessel may be sealed pneumatically as the counter and working electrodes are pneumatically biased against the deposition frame portion.

Deposition may be carried out and monitored using an applied-potential algorithm that may be specifically tailored to the material to be deposited at the working electrode (e.g., a conducting polymer (CP) deposited via electropolymerization at the working electrode from a deposition solution that contains monomers of the CP). At the completion of the deposition, the deposition solution may be drained and the deposition chamber may opened, thus opening the vessel, from which the substrate (i.e., the working electrode), may be removed for further processing. The exemplary device described herein, as well as the process related to the use of the same, may be amenable to automation and provides a solution to the needs in the field as outlined above.

In another aspect, the present invention includes a method for electrochemically depositing a coating material on a working electrode with an electrochemical deposition apparatus of the invention. The method may include mounting a working electrode at a first electrode mount of the apparatus. The method may include mounting a counter electrode at a second electrode mount. In addition, the methods of the invention may include preparing a deposition chamber by (1) biasing the working electrode against a first aperture portion of a deposition chamber frame; and/or (2) biasing the counter electrode against a second aperture portion of the deposition chamber frame. The methods of the invention may also include the step of providing a deposition solution to the deposition chamber, where the deposition solution may include the coating material. The methods of the invention may then include applying a potential across the working electrode and the counter electrode to electrochemically deposit the coating material at the working electrode. Additionally, the methods of the invention may include removing the working electrode, having the coating material deposited thereon, from the first electrode mount.

In one embodiment, the methods of the invention may include providing the deposition solution to the deposition chamber by gravity flowing the deposition solution to the deposition chamber from a container that is in fluid communication with the deposition chamber by raising the container above the deposition chamber.

In another embodiment, the methods of the invention may include the step of removing the deposition solution from the deposition chamber by gravity flowing the deposition solution to the container from the deposition chamber by lowering the container below the deposition chamber.

The step of applying a potential across the working electrode and the counter electrode, according to the methods of the invention may include applying a linear scan applied potential, which may include scanning the applied potential from a pre-determined initial potential to a pre-determined final potential at a pre-determined scan rate. Alternatively, or in addition thereto, the step of applying a potential across the working electrode and counter electrode, according to the methods of the invention, may include applying a fixed applied potential or multiple fixed applied potentials, which may include applying (a) pre-determined fixed potential(s) until: (1) a pre-determined total charge is achieved; or (2) a pre-determined total deposition time has elapsed.

The step of preparing the deposition solution chamber may include at least one of: (1) pneumatically biasing the working electrode against the first aperture portion of the deposition chamber frame; and (2) pneumatically biasing the counter electrode against the second aperture portion of the deposition chamber frame.

The present application incorporates several references that describe certain aspects of electrochromic technology, specifically, U.S. Pat. Nos. 5,995,273; 6,033,592; and 8,902,486; and U.S. Patent Application Publication Nos. 2013/0120821 and 2014/0268283, the entirety of which are incorporated herein by reference.

BRIEF DESCRIPTION OF THE DRAWINGS

The foregoing summary and the following detailed description of the exemplary embodiments of the present invention may be further understood when read in conjunction with the appended drawings, in which.

DETAILED DESCRIPTION OF THE INVENTION

The present invention relates generally to electrochemical deposition (e.g., electrochemical polymerization or "electroplating") of coating materials from deposition solutions onto desired substrates in a tank or vessel. More particularly, the present invention relates to the electrochemical deposition of electrochromic conducting polymers from their monomer containing solutions onto a conductive substrate using a tank or vessel that facilitates automation of an electrochemical deposition process. These features include, by way of example, but not limited to, pneumatic opening/closing and sealing of the tank or vessel, minimization of monomer solution volume, and devices for electrical connection to substrates that minimize or reduce resistive drop.

Figure 1:
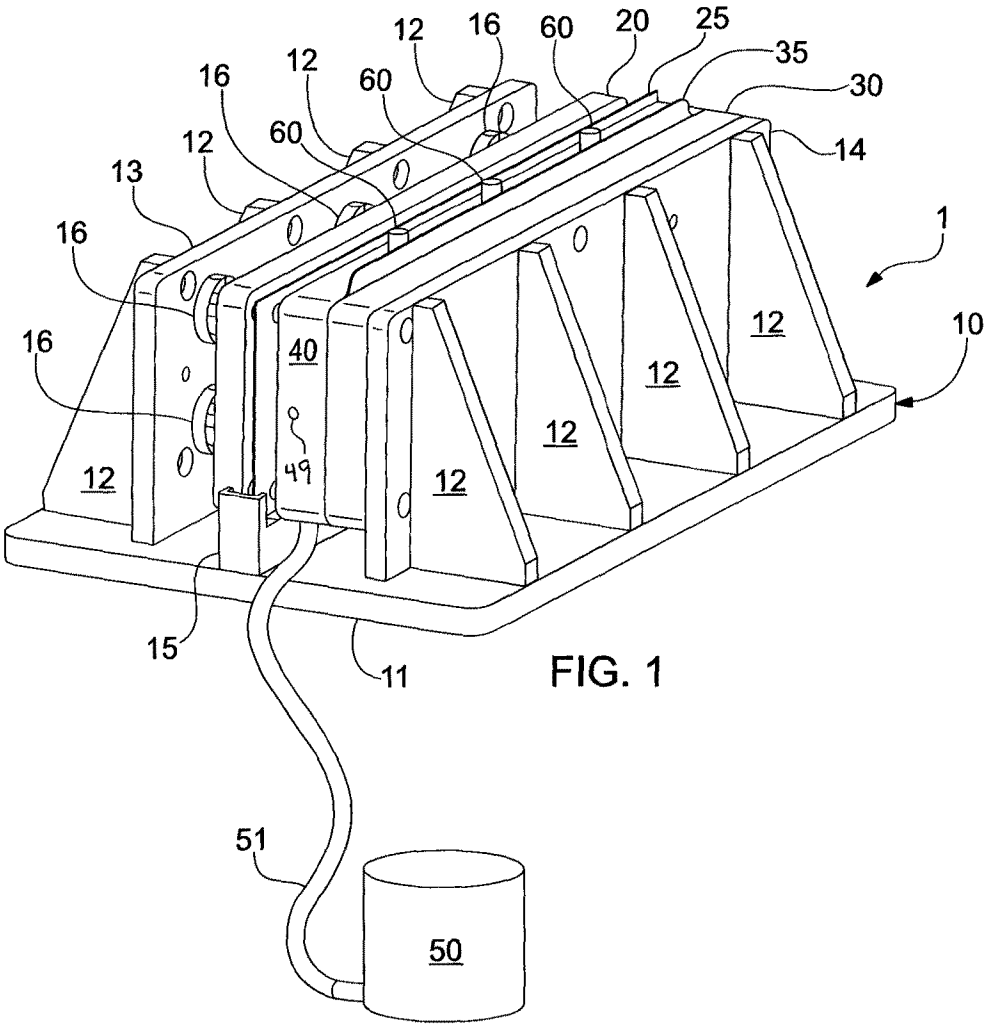
FIG. 1 schematically illustrates a perspective view of an exemplary electrochemical deposition apparatus of the invention.
Figure 2:
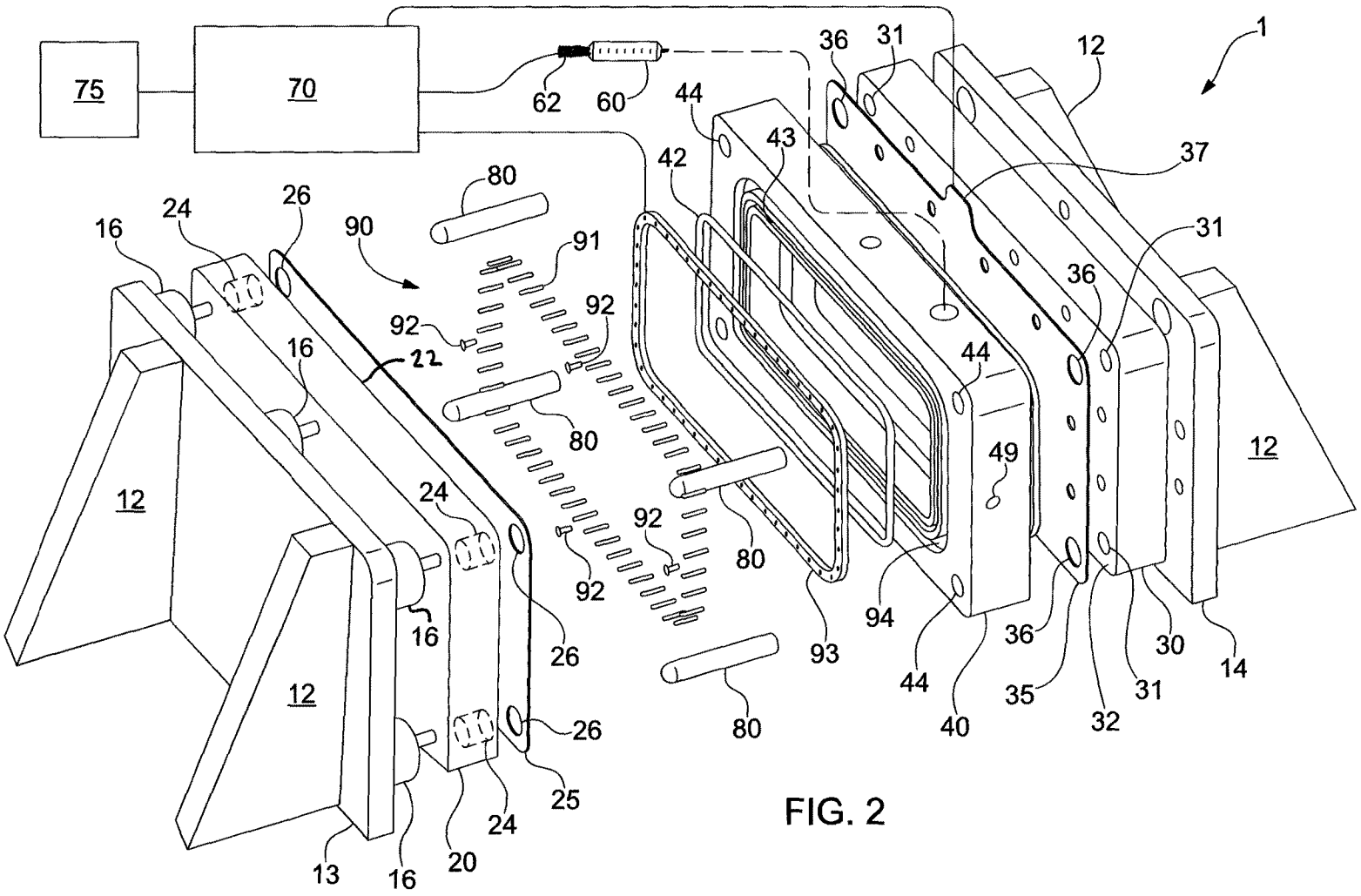
FIG. 2 schematically illustrates an exploded view of an exemplary electrochemical deposition apparatus of the invention.

Referring now to the figures, wherein like elements are numbered alike throughout, FIGS. 1 and 2 provide an exemplary electrochemical deposition apparatus 1. The apparatus 1 includes a support structure 10. A first electrode mount 20 and second electrode mount 30 may be connected to the support structure 10. The first electrode mount 20 and second electrode mount 30 may be used to mount electrodes upon which electrochemical deposition may occur. A deposition chamber frame 40 may be placed proximate to the first electrode mount 20 and the second electrode mount 30. The deposition chamber frame 40 may be placed between the first electrode mount 20 and second electrode mount 30 such that when the first electrode mount 20 and the second electrode mount 30 are biased against the sides of the deposition chamber frame 40, they may combine to form a deposition chamber or vessel, which may receive a deposition solution.

When the first electrode mount 20 and second electrode mount 30 are separated from the deposition chamber frame 40, the apparatus 1 is in its "open" configuration, during which an electrode may be placed on the first electrode mount 20 or second electrode mount 30. When the first electrode mount 20 and second electrode mount 30 are biased against the sides of the deposition chamber frame 40, thereby forming a deposition chamber or vessel, the apparatus 1 is in its "closed" configuration, during which the vessel may be filled with a deposition solution as described herein.

Figure 3:
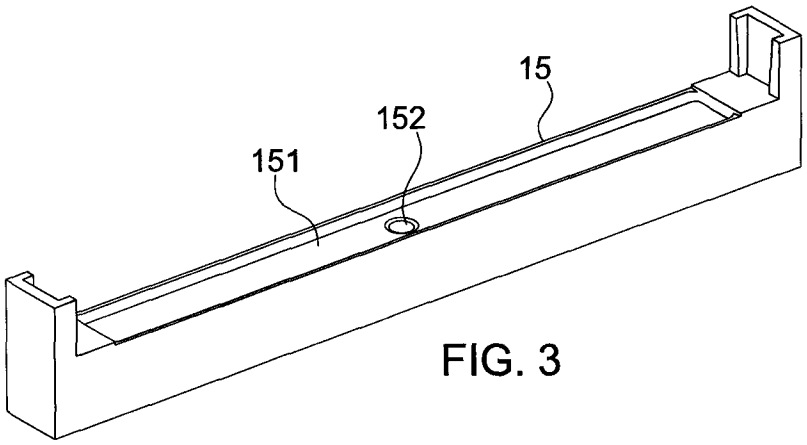
FIG. 3 schematically illustrates a perspective view of a tank support member.

The support structure 10 may include several components that support one or more of the first electrode mount 20, the second electrode mount 30, and the deposition chamber frame 40. The support structure 10 may include a base 11, support plates 13 and 14, a support member 15, and brackets 12. As shown in FIG. 1, the support plates 13 and 14 may be positioned on the base 11 and supported by brackets 12. The support member 15 may be positioned at the base 11, proximate to the support plates 13 and 14. Specifically, the support member 15 may be placed between the support plates 13 and 14 and may support one or more of the first support mount 20, the second electrode mount 30, and the deposition chamber frame 40. In particular embodiments, the support member 15 is fixed to the base 11 and is provided to support first electrode mount 20 and/or the deposition chamber frame 40 when the apparatus 1 is in its closed configuration. As shown in FIG. 3, the support member 15 may include a basin 151 and a drain 152. The basin 151 may catch any deposition solution that escapes the deposition chamber frame 40 during operation of the apparatus 1. Moreover, the drain 151 may allow any deposition solution caught within the basin 151 to be removed or collected.

The components of the support structure 10 may be composed of a metal (e.g., aluminum), a polymeric material (e.g., high density polyethylene (HDPE)), or a combination thereof. In certain preferred aspects, the components of the support structure 10 may be composed of aluminum. For example, the base 11, support brackets 12, support plates 13 and 14, and vessel support member 15 may be composed of aluminum.

The first electrode mount 20 may be connected to the support plate 13 and the second electrode mount 30 may be connected to the support plate 14. One or both of the first electrode mount 20 and second electrode mount 30 may be connected to support plates 13 and 14, respectively, through a biasing member 16. For example, both the first and second electrode mounts 20 and 30, respectively, may be connected to the support plates 13 and 14, respectively, through a biasing member 16. In contrast, one of the first and second electrode mounts 20 and 30, respectively, may be connected to the support plate 13 or 14 via a biasing member 16 while the other electrode mount is connected to the other support plate by a fastener. As used herein, the term "fastener" refers to something that attaches or joins two or more parts together. In some embodiments, a fastener may be a mechanical fastener that mechanically joins or affixes two or more objects together (e.g., a screw, a pin, a rivet, and the like). In other embodiments, a fastener may be a chemical fastener that that chemically joins or affixes two or more objects together (e.g., glue, epoxy, adhesive, solder, and the like). In an exemplary embodiment, the first electrode mount 20 may be connected to the support plate 13 via one or more biasing members 16 and the second electrode mount 30 may be connected to support plate 14 with one or more fasteners.

As shown in FIGS. 1 and 2, the present invention may include several biasing members 16. The term "biasing member" may represent a spring, a clamp, an actuator, or a combination thereof. When the biasing member is an actuator, the actuator may be a hydraulic actuator, a pneumatic actuator, or a combination thereof. In certain embodiments, the biasing member 16 is a pneumatic actuator as shown in FIGS. 1 and 2. In accordance with the present invention, hydraulic and/or pneumatic actuators may be connected to a source of hydraulic and/or pneumatic pressure and a switch that may activate (extend) and/or deactivate (retract) such hydraulic and/or pneumatic actuators.

Moreover, the apparatus 1 may include 1 to 10 biasing members. Preferably, the apparatus 1 may include 4 to 6 biasing members, where the biasing members are pneumatic actuators. The biasing members 16 of the invention may be used to open and close the apparatus 1 as described above.

The first electrode mount 20 and the second electrode mount 30 may be composed of a chemically inert polymeric material, such as HDPE. Moreover, each of the first electrode mount 20 and the second electrode mount 30 may include a flexible backing material on their respective mounting faces 22 and 32. The flexible backing materials may be a sheet that includes ethylene propylene diene monomer (EPDM), silicone rubber, or a combination thereof.

Figure 4:
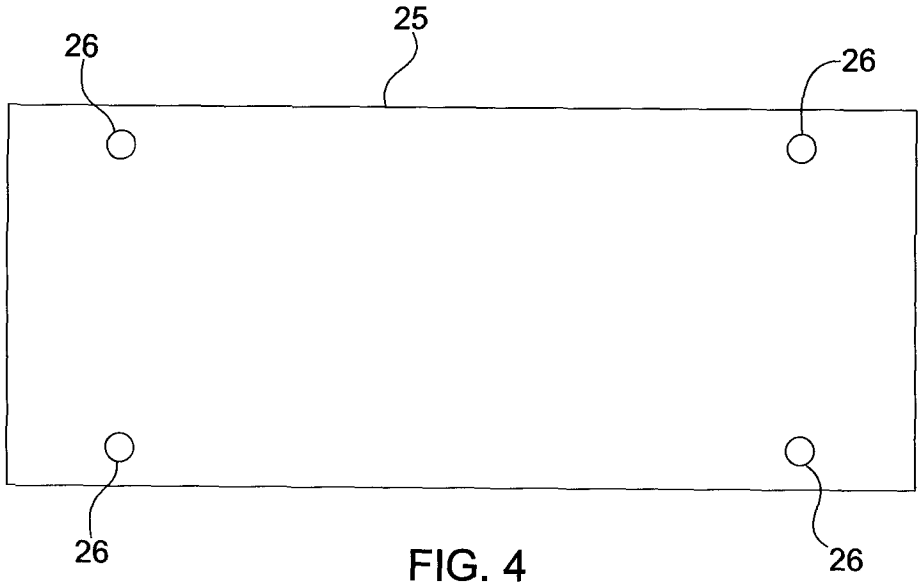
FIG. 4 schematically illustrates a perspective view of an exemplary working electrode.

A first electrode 25 may be mounted on the first electrode mount 20. An exemplary first electrode 25 is provided in FIG. 4. The first electrode 25 may include a conductive sheet or film upon which a coating material may be deposited during an electrochemical reaction. The first electrode 25 may include a metallic material, a non-metallic material, or a combination thereof, provided that the electrode is conductive. For example, the first electrode 25 may include a material selected from the group consisting of indium tin oxide (ITO), poly ethylene terephthalate (PET), glass, or a combination thereof. In a specific embodiment, the first electrode 25 may include a sheet or film of ITO/PET or ITO/glass. Moreover, the first electrode 25 may have a surface resistivity of about 20 to 100 Ohms per square.

In another embodiment of the invention, the first electrode 25 may be shaped in the form of a lens, such as an eyeglass lens, in preference to a simple rectangular, circular, or oval shape, such that it is prepared for assembly into a lens without the need for further cutting or shaping.

Figure 5:
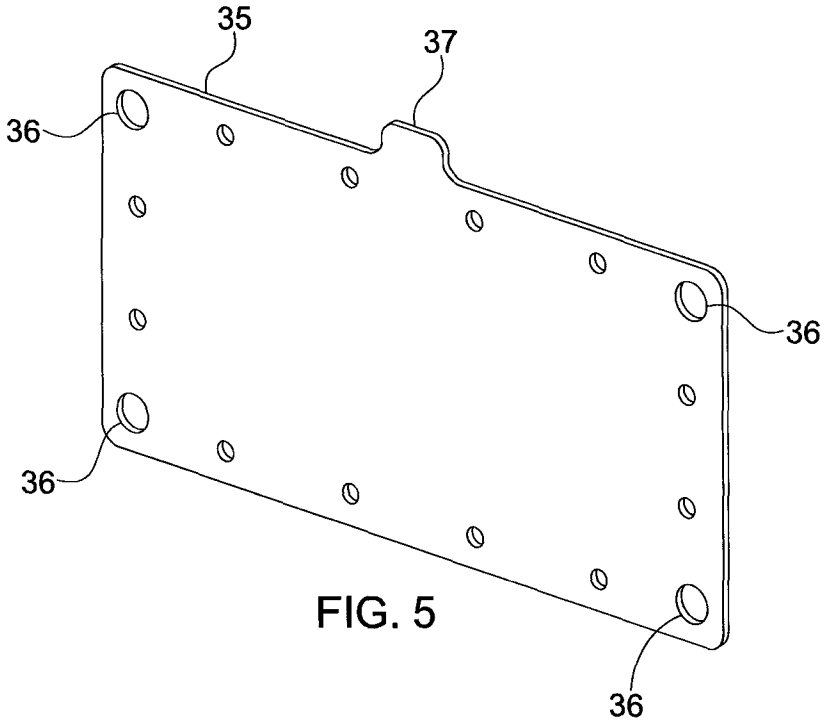
FIG. 5 schematically illustrates a perspective view of an exemplary counter electrode.

The second electrode 35 may be mounted on the second electrode mount 30. An exemplary second electrode 35 is provided in FIG. 5. The second electrode 35 may include a conductive sheet or film. The second electrode 35 may include a metallic material, a non-metallic material, or a combination thereof, provided that the electrode is conductive. By way of non-limiting example, the second electrode 35 may include graphite, gold, or platinum. In a specific embodiment, the second electrode 35 may be a conductive sheet of graphite. Moreover, as shown in FIG. 5, the second electrode 35 may include contact site 37. The contact site 37 may be a tab or portion of the second electrode 35 that is amenable to attaching a clip, clamp, wire, or a combination thereof.

As described herein, the first electrode 25 is preferably the working electrode. In the present invention, the working electrode is the substrate upon which a coating material may be deposited during an electrochemical reaction. The second electrode 35 is preferably the counter electrode. In the present invention, the counter electrode is provided to complete the electrochemical cell. Accordingly, where the working electrode is configured to be a cathode, the counter electrode will be the anode, and vice versa.

The first electrode 25 and second electrode 35 may include guide holes 26 and 36, respectively. The guide holes 26 and 36 may be aligned with guide holes 24 and 31 on the first electrode mount 20 and second electrode mount 30, respectively. Additionally, the deposition chamber frame 40 may include guide holes 44. Through the listed guide holes (i.e., guide holes 24, 26, 31, 36, and 44) may be placed guide pins 80. As shown in FIG. 2, the apparatus 1 may include four guide pins 80 that may be provided through guide holes 24, 26, 31, 36, and 44 in order to align the various components of the apparatus 1.

Figure 6:
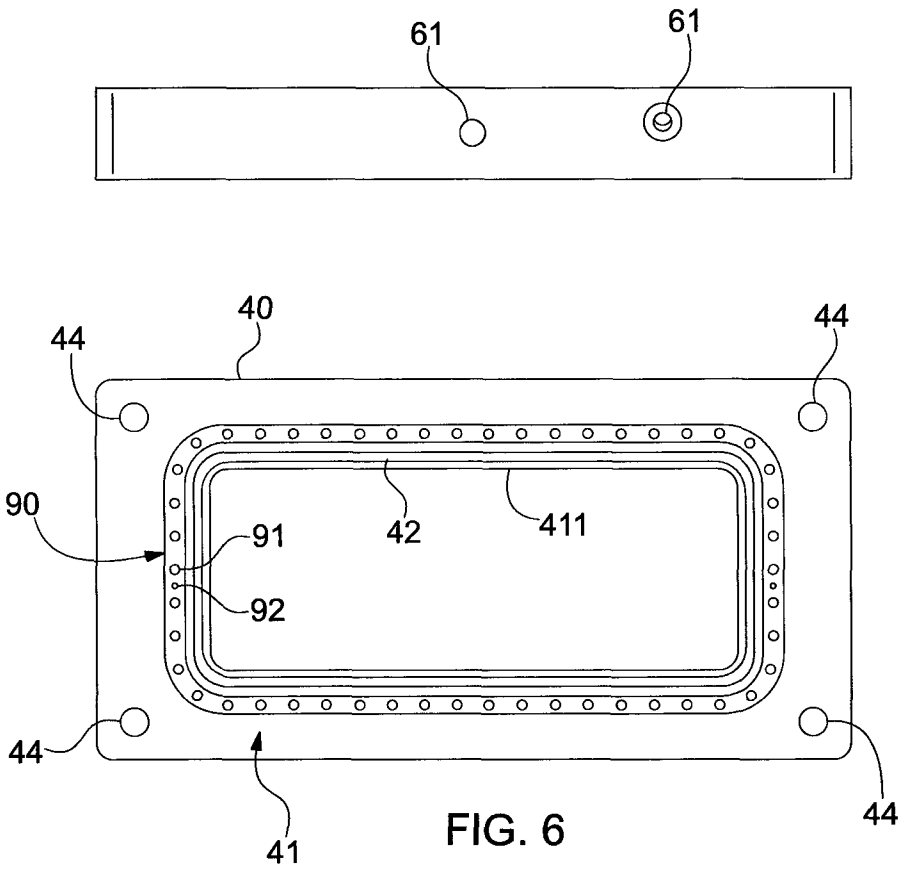
FIG. 6 schematically illustrates a view of the second aperture portion on the deposition chamber frame of the invention.
Figure 7:
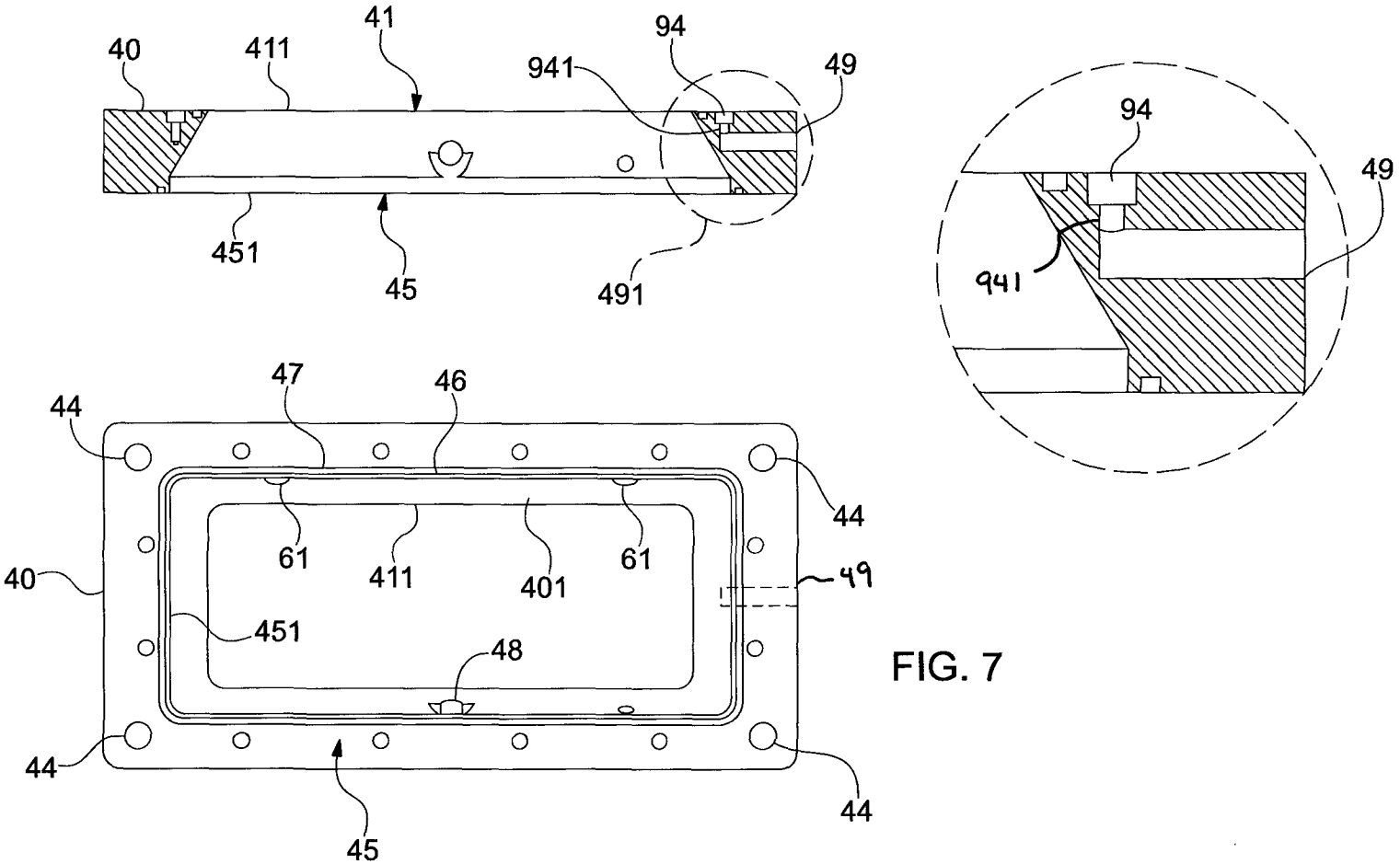
FIG. 7 schematically illustrates a view of the first aperture portion on the deposition chamber frame of the invention.

The deposition chamber frame 40 is shown in FIGS. 1, 2, 6 and 7. The deposition chamber frame 40 may be disposed proximate to the first electrode mount 20 and the second electrode mount 30. More particularly, the deposition chamber frame 40 may be placed between the first electrode mount 20 and the second electrode mount 40, such that when the apparatus 1 is in its closed configuration, the first electrode mount 20, the second electrode mount 30, and the deposition chamber frame 40 may form a deposition chamber or vessel. For example, deposition chamber frame 40 may have a hollow interior as shown in FIG. 7 as cavity 401. The volume of cavity 401 may be filled with a deposition solution when the apparatus 1 is in the closed configuration.

The deposition chamber frame 40 may have a first aperture portion 41 and a second aperture portion 45.

First aperture portion 41 may be the portion of the deposition chamber frame 40 that may face the first electrode mount 20 and/or the first electrode 25. When the apparatus 1 is in its closed configuration, the first aperture portion 41 may abut the first electrode mount 20 or the first electrode 25 when the first electrode 25 is mounted at the first electrode mount 20. The first aperture portion 41 may include a first aperture 411 and a conductive perimeter element 90. The conductive perimeter element 90 may contact, and electrically communicate with, a portion of the first electrode 25. The conductive perimeter element 90 may include at least one conductor or electrode contact that may electrically communicate with a portion of the first electrode 25. For example, the conductive perimeter element 90 may be a continuous conductor or electrode contact that may have a rectangular shape, a square shape, a circular shape, an oval shape, or a combination thereof. Moreover, the conductive perimeter element 90 may be a continuous conductor or electrode contact that may have a shape configured to match a lens (e.g., an electrochromic lens) or a shape suited to match the application for which the coated or plated substrate is to be used.

In another embodiment, the conductive perimeter element 90 may encompass a plurality of conductor or electrode contacts that may be arranged to provide a rectangular shape, a square shape, a circular shape, an oval shape, or a combination thereof. Moreover, the conductive perimeter element 90 may be a plurality of conductor or electrode contacts that may be arranged to provide a shape configured to match a lens (e.g., an electrochromic lens) or a shape suited to match the application for which the coated or plated substrate is to be used. In a preferred embodiment of the invention, the conductive perimeter element 90 may be a plurality of conductor or electrode contacts as set forth in FIGS. 2 and 6.

As shown in FIGS. 2 and 6, the conductive perimeter element 90 may be set into the first aperture portion 41 of the deposition chamber frame 40. The conductive perimeter element 90 may include a plurality of electrode contacts 91. Electrode contacts 91 may be deformable or biased conducting pins. For example, electrode contacts 91 may be spring loaded conducting pins (e.g., POGO pins).

The conductive perimeter element 90 may also include a conductive base 93 upon which the plurality of electrode contacts 91 may be connected. The conductive base 93 may be set into a base channel 94 on the first aperture portion 41 of the deposition chamber frame 40. The conductive base 93 may be connected to the deposition chamber frame 40 with one or more fasteners. As shown in FIGS. 2 and 7, the conductive base 93 may be fastened to the deposition chamber frame 40 in the base channel 94 with one or more screws, such as screws 92.

As shown in FIGS. 2 and 7, the deposition chamber frame 40 includes an electrical connection tunnel 49 (see, e.g., inset 491 of FIG. 7). The electrical connection tunnel 49 communicates with a conductor 941 that electrically communicates with the conductive base 93. Accordingly, a wire that may be connected to a power source or controller, as described herein, may be passed through the electrical connection tunnel 49 to contact the conductor 941 and allow a power source and/or a controller to electrically communicate with the conductive base 93. Alternatively, element 941 may be an aperture through which a wire may be passed to contact the conductive base 93.

The first aperture portion 41 may also include a gasket 42 that may be set into a gasket channel 43. The gasket 42 may be composed of a flexible, chemically inert material such as EPDM, silicone rubber, or a combination thereof. The gasket 42 may be provided to maintain a seal that prevents leakage of deposition solution when the apparatus 1 is in its closed configuration (e.g., when the first electrode 25 is biased against the first aperture portion 41 of deposition chamber frame 40). Moreover, the gasket 42 prevents contact between the conductive perimeter element 90 and the deposition solution when the apparatus 1 is in its closed configuration. Accordingly, the perimeter of the conductive perimeter element 90 is preferably greater than the perimeter of the gasket 42.

In certain embodiments of the invention, the design of the the first aperture 411 and the gasket 42 may be modified to act as a mask on the first electrode 25 to control the manner in which a coating or plating material is deposited at the first electrode 25. For example, the first aperture 411 and the gasket 42 may be sized to provide a rectangular shape, a square shape, a circular shape, an oval shape, or a combination thereof. Moreover, the first aperture 411 and the gasket 42 may be sized to provide a shape configured to match a lens (e.g., an electrochromic lens) or a shape suited to match the application for which the coated or plated material is to be used. For example, the first aperture 411 and the gasket 42 may be sized to provide the shape of a motorcycle helmet visor or spectacle lens. Indeed, the first electrode contact 25 may be used as a film or layer in an electrochromic device that may be applied to a motorcycle helmet visor. Accordingly, the first aperture 411 and the gasket 42 may be sized to match the shape of the visor to simplify production where the first electrode is also sized to match the application for which the coated or plated substrate is to be used.

Second aperture portion 45 may be the portion of the deposition chamber frame 40 that may face the second electrode mount 30 and/or the second electrode 35. When the apparatus 1 is in its closed configuration, the second aperture portion 45 may abut the second electrode mount 30 or the second electrode 35 when the second electrode 35 is mounted at the second electrode mount 30. As shown in FIG. 7, the second aperture portion 45 may include a second aperture 451. The second aperture 451 may be larger than the first aperture 411. For example, the second aperture 451 may be at least about two times larger than the first aperture 411. In addition, the second aperture 451 may be about three times larger than the first aperture 411.

Furthermore, the first aperture 411 and the second aperture 451 may define the front and back, respectively, of the cavity 401. The cavity 401, between the first aperture 411 and the second aperture 451, may be telescoped, tapered, or a combination thereof. In certain specific embodiments, the cavity 401 tapers from the second aperture 451 to the first aperture 411 as shown, at least, in FIG. 7. More broadly, the deposition chamber frame 40 may have a tapered or telescoped cavity 401, such that the counter electrode area is larger and/or significantly larger (e.g., at least twice as large) than the working electrode area, so that limiting electrode processes do not occur at the counter electrode.

The second aperture portion 45 may include a gasket 46 that may be set into a gasket channel 47. The gasket 46 may be composed of a flexible, chemically inert material such as EPDM, silicone rubber, or a combination thereof. The gasket 46 may be provided to maintain a seal that prevents leakage of deposition solution when the apparatus 1 is in its closed configuration (e.g., when the second electrode 35 is biased against the second aperture portion 45 of the deposition chamber frame 40).

As shown in FIG. 7, the deposition chamber frame 40 may include a frame inlet/outlet 48. The frame inlet/outlet 48 may be in fluid communication with a container 50. Specifically, the apparatus 1 may include a tube 51 that connects the container 50 to the frame inlet/outlet 48. The frame inlet/outlet 48 allows the deposition chamber frame 40 to receive a deposition solution during a deposition process when the apparatus 1 is in its closed configuration. Moreover, the frame inlet/outlet 48 allows the deposition chamber frame 40 to empty of the deposition solution after a deposition process and before the apparatus 1 is reset to its open configuration.

The deposition chamber frame 40 may also include one or more vent apertures 61. The vent apertures 61 may communicate with the cavity 401 of the deposition chamber frame 40. Moreover, the present invention may include one or more stoppers 60 that may be placed into the vent apertures 61. The stoppers 60 may be composed of a flexible, chemically inert material such as EPDM, silicone rubber, or a combination thereof.

The present invention may also include a reference electrode 62 that may be placed within the cavity 401 of the deposition chamber frame 40. For example, as shown in FIG. 2, at least one of the stoppers 60 may include a hole through which the reference electrode 62 may be provided. Therefore, when passing through a stopper 60, the reference electrode 62 may be placed within the cavity 401 while maintaining the integrity of the cavity 401 and the deposition chamber frame 40. The reference electrode 60 may be any type of electrochemical reference or quasi-reference electrode known to those persons having ordinary skill in the art. However, in preferred embodiments, the reference electrode 60 is a Ag/AgCl reference electrode or a Pt or Au wire quasi-reference electrode. Moreover, in particular embodiments, the reference electrode 60 is configured to be placed within the cavity 401 of the deposition chamber frame 40 such that it may be proximate to the first electrode 25 and the second electrode 35 when the apparatus 1 is in its closed configuration. Preferably, the reference electrode 60 is configured to be placed within the cavity 401 of the deposition chamber frame 40 such that it may be closer to the first electrode 25 as compared to the second electrode 35 when the apparatus 1 is in its closed configuration. Indeed, the reference electrode 60 may be preferably disposed at a position that is closer to the working electrode (i.e., the first electrode 25), compared to the counter electrode (i.e., the second electrode 35), such that the applied potential at the working electrode is more accurately regulated.

As described herein, the apparatus 1 may include a container 50 that may be fluidly connected to the deposition chamber frame 40 through a tube 51. Specifically, a bottom portion of the container 50 may be connected through the tube 51 to the frame inlet/outlet 48, which is preferably placed at the bottom of the deposition chamber frame 40, as shown in FIG. 7. The present invention allows for gravity flowing a deposition solution contained in the container 50 from the container 50 in order to the fill the cavity of the deposition chamber frame 40 when the apparatus 1 is in its closed configuration. As used herein, the term "gravity flowing," relates to a flow of fluid that is driven by gravity from a higher location to a lower location. For example, filling the deposition chamber frame 40 requires raising the container 50 above a desired fluid level in the deposition chamber frame 40. In contrast, emptying the deposition chamber frame 40 requires lowering the container 50 below a desired fluid level in the deposition chamber frame 40. Due to this arrangement, no pumps are required to fill or empty the cavity 401 of the deposition chamber frame 40 when the apparatus 1 is in its closed configuration.

The deposition solution used in the processes of the invention may include a solvent and one or more coating materials that may be deposited or electroplated onto a first electrode 25 (i.e., the substrate). In certain embodiments, the coating material may include an inorganic coating material (e.g., one or more metal salts) or an organic coating material (e.g., one or more monomers). Where the coating material includes an organic coating material, such as a monomer, deposition at the first electrode 25 (i.e., the substrate) may include electropolymerization. In preferred embodiments, the deposition solution may include monomers of electrochromic conducting polymers, for example, as may be described in U.S. Pat. Nos. 5,995,273 and 6,033,592; and U.S. Patent Application Publication Nos. 2013/0120821 and 2014/0268283.

The solvent of the deposition solution may include a polar aprotic solvent, a non-polar solvent, a polar protic solvent, or a combination thereof, that may be known to a person having ordinary skill in the art provided that the coating material is substantially miscible with the solvent. In certain embodiments, the solvent of the deposition solution is selected from the group consisting of acetonitrile, N,N'-dimethylformamide, and a combination thereof.

The present invention may also include a controller 70 that may be in electrical communication with or otherwise may be configured to be electrically connected to one or more of the first electrode 25, the second electrode 35, and the reference electrode 62. In certain preferred embodiments, the controller 70 is provided to be connected to the first electrode 25 (i.e., the working electrode) through the conductive perimeter element 90, the second electrode 35 (i.e., the counter electrode) through the contact site 37, and the reference electrode 62. The controller 70 may be a potentiostat, a galvanostat, a DC power supply, or a combination thereof.

Preferably, the controller 70 may be a potentiostat/galvanostat as described in pending U.S. patent application Ser. No. 14/844,367, the entirety of which is incorporated herein by reference.

Indeed, the controller 70 may be an electrochemical instrument that may be provided for conducting electrochemical analysis of materials. The electrochemical instrument may be in the form of a potentiostat/galvanostat for conducting electrochemical analysis of materials positioned between a counter electrode and a working electrode of the instrument. The electrochemical instrument may include a microcontroller, for controlling operation of the circuitry of the instrument. The microcontroller may function to operate pursuant to a computer program as well as various inputs from a user to provide various or selected parameters or modes of operation. The microcontroller may produce desired digital control signals. A digital-to-analog converter (DAC) may be provided in electrical communication with the microcontroller for generating an analog output signal in response to digital control signals from the microcontroller. A high current driver may be provided in electrical communication with the DAC to produce a high current range output in response to the analog output signal from the DAC. For example, the high current driver may produce a high current range output in the range of about a fraction of milliAmpere mA or a mA to about amperes As. As a specific optional example, the high current driver may produce current in the range of about 0.25 mA to about 2.5 A. A high current monitor may be provided in electrical communication with the high current driver to monitor the high current range output from the high current driver. The high current monitor may produce a feedback signal for the high current driver in response to the current monitored by the high current monitor to control the current produced by the high current driver. The high current monitor may also supply an output dependent on the current supplied from the high current driver for monitoring by the microcontroller. The high current monitor may also supply a working output signal at a working output for performing analysis of a selected material. For this purpose, a counter electrode contact may be provided for electrical communication with the counter electrode (e.g., second electrode 35) and connectable in electrical communication with the working output of the high current monitor. A working electrode contact may be provided for electrical communication with a working electrode (e.g., first electrode 25) and may be electrically connectable with a fixed stable voltage potential (for example, ground or virtual ground) for enabling electrochemical analysis of material at or between the counter electrode and the working electrode. For example, a selected working output signal from the high current monitor may be applied from the counter electrode at or through the material being analysed or tested and then to the working electrode.

A low current driver may also be optionally provided in electrical communication with the DAC to produce a low current range output in response to the analog output signal from the DAC. For example, a low current range output may be in the range of about nanoAmperes nAs, and perhaps even as small as picoAmperes pAs, to about a mA or a fraction of a mA. As a specific optional example, the low current driver may produce current in the range of about 2.5 nA to 0.25 mA. The low current driver may be in electrical communication with the counter electrode contact so that the low current range output may be supplied by the low current driver to the counter electrode. A low current monitor may be connectable in electrical communication with the working electrode contact for detecting current at the working electrode contact. In a low current mode of operation, the low current range output from the low current driver may be supplied to the counter electrode through or at the material being analysed or tested and then to the working electrode. The low current monitor in electrical communication with the working electrode may supply an output dependent on the current detected at the working electrode contact for monitoring by the microcontroller. The low current monitor may also provide a feedback signal for the low current driver in order to control the output of the low current driver to control the current between the counter electrode contact and the working electrode contact. The low current monitor may optionally include a monitor amplifier having an amplifier input connectable in electrical communication with the working electrode contact and having an amplifier output. The low current monitor may also include an array of feedback resistors connected between the output of the monitor amplifier and the input of the monitor amplifier. The low current monitor may also include a monitor multiplexer, for example, an analog multiplexer, in electrical communication with the microcontroller for selecting at least one of the feedback resistors in the array for electrical communication between the output and input of the monitor amplifier to control the output of the monitor amplifier.

The high current monitor may optionally include a first high current range monitoring circuit for monitoring current in a first high current range and a second high current monitoring circuit for monitoring current in a second high current range. As an optional example, the first high current monitoring circuit may operate in a range of about mAs to about an A whereas the second high current monitoring circuit may operate in a range of about a fraction of a mA to about mAs. As a more specific optional example, the high current monitoring circuit may operate in a range of about 25 mA to 2.5 A and the second high current monitoring circuit may operate in a range of about 0.25 mA to 25 mA. Of course, the two ranges need not precisely overlap at a common end point and such common end point can be altered to a different magnitude.

The instrument may also include a reference electrode contact for electrical communication with a reference electrode (e.g., reference electrode 62) for positioning relative to the working electrode and counter electrode in communication with the material, and a buffer in electrical communication with the reference electrode contact for detecting voltage at the reference electrode contact. The buffer may supply an output dependent on the voltage detected at the reference electrode contact that is buffered from the reference electrode contact for monitoring by the microcontroller. The buffer may also selectively provide a feedback signal for the high current driver to control the output produced by the high current driver when operating in voltage mode at a high current or high power mode of operation in order to control the voltage at the reference electrode contact. The buffer may also supply the feedback signal from the buffer to the low current driver to control the output produced by the low current driver to control the voltage at the reference electrode contact when operating in voltage mode at a low current or low power mode of operation. In order to accommodate such an optional arrangement having both a high current driver and a low current driver, the instrument may also include a high current switch for switchably connecting the high current driver in and out of electrical communication with the counter electrode contact and a low current switch for switchably connecting the low current driver in and out of electrical communication with the counter electrode contact. The microcontroller may function to enable or disable output from either or both of the high current or low current drivers to respectively provide a type of high current switch and a low current switch, respectively, to connect and disconnect from the counter electrode contact. The microcontroller may operate to control the high current switch and the low current switch so that when the high current switch electrically connects the high current driver into electrical communication with the counter electrode contact, the microcontroller causes the low current switch to switch the lower current driver out of electrical communication with the counter electrode contact. Likewise, when the low current switch switches the low current driver into electrical communication with the counter electrode contact, the high current switch electrically disconnects the high current driver from electrical communication with the counter electrode contact. For an optional arrangement in which the high current monitor includes both a first high current monitoring circuit and a second high current monitoring circuit, the high current switch may include a first high current monitor switch for electrically connecting the first high current range monitoring circuit in and out of electrical communication with the counter electrode contact and a second high current monitoring switch for electrically connecting the second high current monitoring circuit in and out of electrical communication with the counter electrode contact. In operation, the microcontroller may be in electrical communication with the first and second high current monitoring switches such that when one of the high current monitoring switches is turned on the other high current monitoring switch is turned off and when at least one of the high current monitoring switches is turned on then the low current switch is turned off under the control of the microcontroller.

The instrument may also include a ground switch under the control of the microcontroller for electrically connecting the working electrode contact in and out of electrical communication with a fixed stable voltage potential such as ground or virtual ground. When the high current driver is switched by the high current switch to be in electrical communication with the counter electrode contact, such as when operating in a high power or high current mode of operation, the microcontroller may control the ground switch to connect the working electrode contact to ground.

The instrument may also include a low current monitor switch under the control of the microcontroller for switchably connecting the working electrode contact in and out of electrical communication with the low current monitor. In a low power or low current mode of operation, the low current monitor switch electrically connects the working electrode contact into electrical communication with the low current monitor and the low current switch operates to connect the low current driver in electrical communication with the counter electrode contact. In a high current or high power mode of operation, the low current monitor switch may also function to disconnect the working electrode contact out of electrical communication with the low current monitor, and the low current switch may function to disconnect the low current driver out of electrical communication with the counter electrode contact.

Next, the instrument may also include a feedback multiplexer, for example, an analog multiplexer, in electrical communication with the microcontroller and in electrical communication with the high current monitor for receiving the feedback signal from the high current monitor, the buffer for receiving the feedback signal from the buffer, and the low current monitor for receiving the feedback signal from the low current monitor, and for switchably selecting which of the feedback signals, or a signal dependent thereon, is output by the feedback multiplexer under the control of the microcontroller. In this regard, the microcontroller may operate to control the feedback multiplexer to supply the feedback signal from the high current monitor for the high current driver when operating in high current mode and to supply the feedback signal from the low current monitor for the low current driver when operating in low current mode, and to supply the feedback signal from the buffer for at least one of the high current driver or low current driver when operating in voltage mode. For example, the feedback multiplexer may supply the feedback signal from the buffer for the high current driver when operating in voltage mode at a high power mode of operation and for the low current driver when operating in voltage mode at a low power mode of operation. Optionally, the first high current range monitoring circuit may provide a first high current feedback signal for the feedback multiplexer and the second high current monitoring circuit may supply a second high current feedback signal for the feedback multiplexer. When operating in the high current mode, the multiplexer under the control of the microcontroller may selectively supply the first high current feedback signal from the first high current range monitoring circuit for the high current driver when operating in first high current range and selectively supply the second high current feedback signal from the second high current range monitoring circuit for the high current driver when operating in the second high current range. The first high current range monitoring circuit may include a first sense resistor connected in series between the high current driver and the counter electrode contact and a first differential amplifier, such as an instrumentation amplifier, connected across the first sense resistor to detect the voltage produced by the current flow through the first sense resistor to provide the first high current feedback signal. Likewise, the second high current range monitoring circuit may include a second sense resistor connected in series between the high current driver and the counter electrode and a second differential amplifier, such as an instrumentation amplifier, connected across the second sense resistor to detect the voltage produced by current flow through the second sense resistor to provide the second high current feedback signal. Preferably, the first and second sense resistors are connected in parallel circuits and have different magnitudes of resistance, optionally such as a $10^2$ magnitude difference such as 0.1 and 10 ohms for example.

The instrument may also include an analog-to-digital converter (DAC) in electrical communication with the outputs of the low current monitor, the buffer and the high current monitor to convert the output signals of the low current monitor, the buffer and the high current monitor to digital signals for the microcontroller.

In an optional arrangement, the buffer may also be in electrical communication with the counter electrode contact for detecting a voltage at the counter electrode contact and for supplying a buffered output indicating the voltage at the counter electrode contact for electrical communication with the microcontroller.

The controller 70 may include an electrochemical instrument for conducting an electrochemical analysis of selected materials that may be configured, adjusted or set to operate in a high power or high current mode of operation and as such may be in the configuration of potentiostat and/or galvanostat for providing selected electrical signals to a counter electrode (e.g., second electrode 35) and a working electrode (e.g., first electrode 25). As configured for a high power or high current mode of operation, the electrochemical instrument may include a microcontroller for providing digital control signals and a digital-to-analog converter (DAC) in electrical communication with the microcontroller for generating an analog output signal in response to digital control signals from the microcontroller. A high current driver may be in electrical communication with the DAC to produce a high current range output in response to the analog output signal from the DAC. For example, the high current range output may be in the ranges previously indicated. A high current monitor may be used in electrical communication with the high current driver to monitor the current output by the high current driver. The high current monitor may produce a current feedback signal for the high current driver in response to the current monitored by the high current monitor to control the current produced by the high current driver. The high current monitor may also supply an output dependent on the current produced by the high current driver for monitoring by the microcontroller. The high current monitor may also supply a working output signal at a work output for application to a material, such as a material under test or analysis. For this purpose, a counter electrode contact for electrical communication with a counter electrode is connectable in electrical communication with the work output of the high current monitor. A working electrode contact for electrical communication with a working electrode may be connected in electrical communication with a fixed stable voltage potential, such as ground or virtual ground, for enabling electrochemical analysis of material at or between the counter electrode and the working electrode. The high current monitor may optionally include a first high current range monitoring circuit for monitoring current in a first high current range and a second high current monitoring circuit for monitoring current in a second high current range. For example, the first and second high current ranges may be in the ranges previously indicated. The high current monitor may also include a first high current monitor switch for electrically connecting the first high current range monitoring circuit in and out of electrical communication with the counter electrode and a second high current monitoring switch for electrically connecting the second high current monitoring circuit in and out of electrical communication with the counter electrode contact, optionally under the control of the microcontroller which may be in electrical communication with the first and second high current monitoring switches.

The instrument may also include a reference electrode contact for electrical communication with a reference electrode (e.g., reference electrode 62) for positioning relative to the working electrode and the counter electrode in communication with the material. A buffer may be provided for electrical communication with the reference electrode contact for detecting voltage at the reference electrode contact and for supplying an output dependent on the voltage at the reference electrode contact that is buffered from the reference electrode contact for monitoring by the microcontroller. The buffer may also provide a feedback signal for the high current driver to control the output produced by the high current driver to control the voltage at the reference electrode contact.

The instrument may also include a feedback multiplexer, optionally in the form of an analog multiplexer, in electrical communication with the microcontroller, and both in electrical communication with the high current monitor for receiving the feedback signal from the high current monitor and in electrical communication with the buffer for receiving the feedback signal from the buffer for switchably selecting under the control of the microcontroller which of the feedback signals, or a signal dependent thereon, is output by the feedback multiplexer for the high current driver. In current mode, the microcontroller will switch the feedback multiplexer to output the feedback signal from the high current monitor for feedback for the high current driver. In voltage mode, the microcontroller will switch the feedback multiplexer to output the feedback signal from the buffer for feedback for the high current driver. Optionally, the first high current range monitoring circuit may provide a first high current feedback signal for the feedback multiplexer and the second high current range monitoring circuit may provide a second high current feedback signal for the feedback multiplexer. The feedback multiplexer may operate under the control of the microcontroller to selectively supply the first high current feedback signal, or a signal dependent thereon, from the first high current range monitoring circuit for the high current driver when operating in the first high current range and to selectively supply the second high current feedback signal, or a signal dependent thereon, from the second high current range monitoring circuit for the high current driver when operating in the second high current range.

Optionally, the first high current range monitoring circuit may include a first sense resistor connected in series between the high current driver and the counter electrode contact, and a first differential amplifier, such as an instrumentation amplifier, connected across the first sense resistor to detect the voltage generated by current flow through the first sense resistor to produce the first high current feedback signals and an output for monitoring by the microcontroller. Likewise, the second high current range monitoring circuit may optionally include a second sense resistor connected in series between the high current driver and the counter electrode contact, and a second differential amplifier, such as an instrumentation amplifier, connected across the second sense resistor to detect the voltage generated by the current flow through the second sense resistor to produce the second high current feedback signal and an output for monitoring by the microcontroller. Preferably, the first and second sense resistors are connected in parallel circuits and have different magnitudes of resistance, optionally such as a $10^2$ magnitude difference such as 0.1 and 10 ohms for example.

The instrument may also include an analog-to-digital converter (ADC) in electrical communication with the microcontroller and in electrical communication with the outputs of the buffer and the high current monitor to convert the output signals of the buffer and the high current monitor to a digital signal for the microcontroller.

Optionally, the buffer may also be connectable in electrical communication with the counter electrode contact for detecting a voltage at the counter electrode contact for supplying a buffered output representing the voltage at the counter electrode contact for electrical communication with the microcontroller.

The controller 70 may include an electromechanical instrument that may be configured, adjusted, or set to operate, for example, as a potentiostat or a galvanostat in a low current or low power mode of operation. When so configured, the instrument includes a microcontroller for providing digital control signals, and a digital-to-analog converter (DAC) in electrical communication with the microcontroller for generating an analog output signal in response to digital control signals from the microcontroller. A low current driver may be positioned in electrical communication with the DAC to produce a low current range output in response to the analog output signal from the DAC. For example, a low current range may be in the range previously indicated. A counter electrode contact may be provided for electrical communication with a counter electrode (e.g., second electrode 35) and for electrical communication with the output of the low current driver. A working electrode contact may also be provided in electrical communication with a working electrode (e.g., first electrode 25) for enabling electrochemical analysis of material between the counter electrode and the working electrode. In operation, current from the low current driver may be supplied to the counter electrode for application at or through the material to be analyzed or tested and then to the working electrode.

The instrument may also include a low current monitor connectable in electrical communication with the working electrode contact for detecting current at the working electrode contact and for supplying an output dependent on the current detected at the working electrode contact for monitoring by the microcontroller. The low current monitor may also provide a feedback signal for the low current driver in order to control the output of the low current driver to control the current between the counter electrode contact and the working electrode contact. The low current monitor may optionally include a monitor amplifier, such as a current feedback amplifier or transimpedance amplifier, having an input connectable in electrical communication with the working electrode contact and providing an output. The low current monitor may also include an array of feedback resistors connected between the output of the monitor amplifier and the input of the monitor amplifier to provide a feedback loop between the output and the input of the monitor amplifier. The low current monitor may also include a monitor multiplexer, for example, an analog multiplexer, in electrical communication with the microcontroller for selecting at least one of the feedback resistors in the array for electrical connection between the output and the input of the monitor amplifier to control the output of the monitor amplifier.

The instrument may optionally include a reference electrode contact for electrical communication with a reference electrode (e.g., reference electrode 62) for positioning relative to the working electrode and the counter electrode in communication with the material. The instrument may also include a buffer for electrical communication with the reference electrode contact for detecting voltage at the reference electrode contact. The buffer may function to supply an output dependent on the voltage at the reference electrode contact that is buffered from the reference electrode contact for monitoring by the microcontroller. The buffer may also provide a feedback signal for the low current driver to control the output produced by the low current driver to control the voltage at the reference electrode contact. In a voltage mode of operation, the voltage at the reference electrode contact may be monitored relative to voltage at the working electrode contact, which may, for example, be a virtual ground.

The instrument may also include a feedback multiplexer, for example, an analog multiplexer, in electrical communication with the microcontroller. The feedback multiplexer may also be in electrical communication with the buffer for receiving the feedback signal from the buffer and in electrical communication with the low current monitor for receiving the feedback signal from the low current monitor for switchably selecting which of the feedback signals input to the feedback multiplexer, or a signal dependent thereon, will be output for the low current driver under the control on the microcontroller. In this regard, the microcontroller may function to control the feedback multiplexer to supply the feedback signal from the low current monitor for the low current driver when operating in low current mode and to selectively supply the feedback signal from the buffer for the low current driver when operating in voltage mode.

The instrument may also include an analog-to-digital converter (ADC) in electrical communication with the microcontroller and in electrical communication with the outputs of the low current monitor and the buffer to convert the output of the low current monitor and the buffer to a digital signal for supply to the microcontroller for monitoring by the microcontroller.

Optionally, the buffer may also be connectable in electrical communication with the counter electrode contact for detecting a voltage at the counter electrode contact and for supplying a buffered output representing the voltage at the counter electrode contact for electrical communication with the microcontroller.

The controller 70 may include or be connected to a power source 75. The power source 75 may include any source of direct current (DC) to the controller 70. In certain embodiments, the power source 75 could include a source of alternating current (AC) that is converted to DC, as is known in the art. The power source 75 may include a battery. As used herein, the term "battery" refers to an electro-chemical device comprising one or more electro-chemical cells and/or fuel cells, and so a battery may include a single cell or plural cells, whether as individual units or as a packaged unit.

Figure 8:
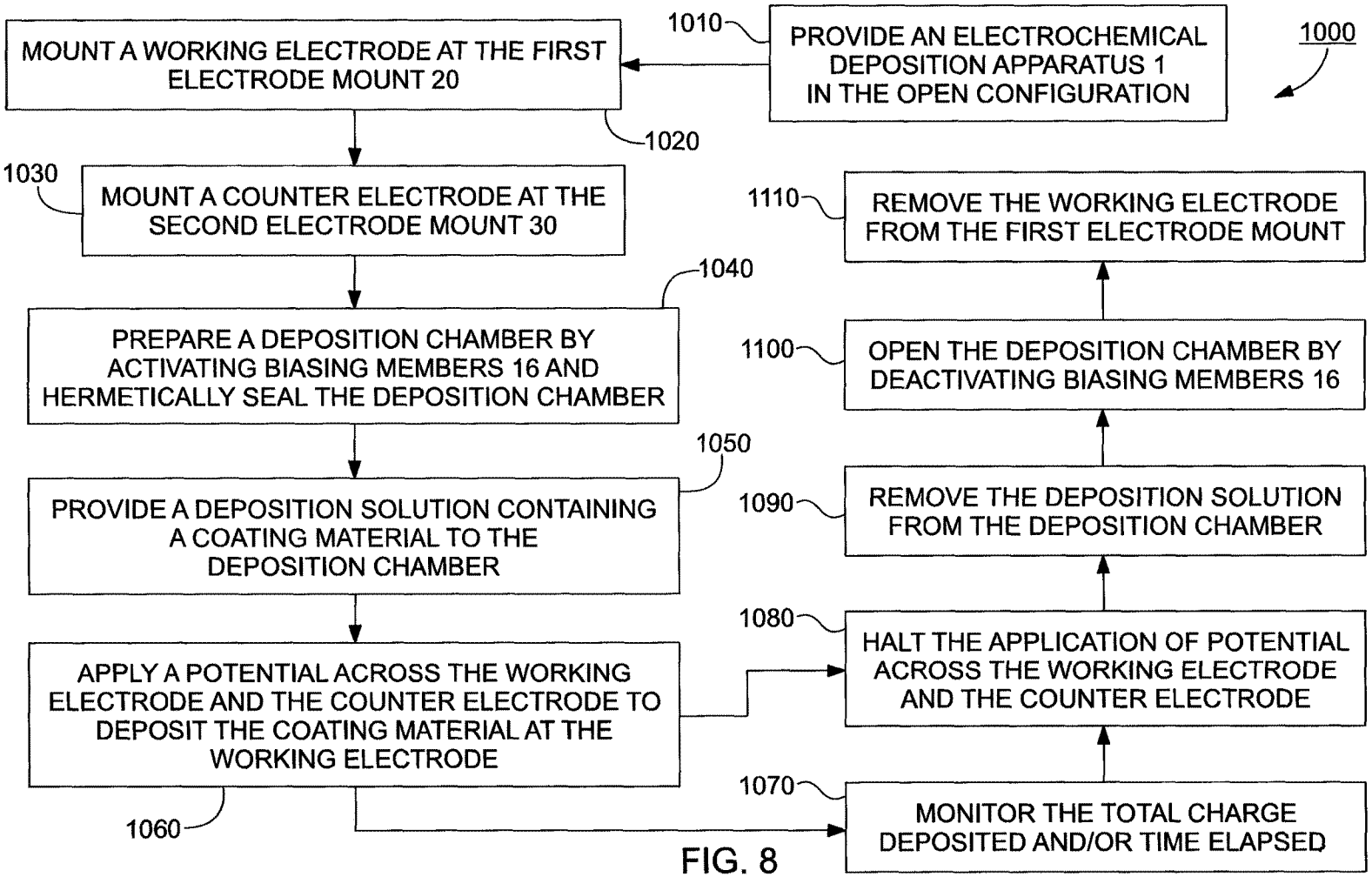
FIG. 8 schematically illustrates a method of using an electrochemical deposition apparatus of the invention to deposit a coating material on a working electrode (i.e., a substrate).

The present invention also includes method 1000, shown in FIG. 8, of using the apparatus 1 to produce a working electrode (e.g., first electrode 25) having a coating material deposited or otherwise electroplated thereon.

The apparatus 1 may be provided in the open configuration (step 1010) so that a first electrode 25 (i.e., the working electrode) may be mounted on the first electrode mount 20 (step 1020) and a second electrode 35 (i.e., the counter electrode) may be mounted on the second electrode mount 30 (step 1030).

Prior to providing the deposition solution, a deposition chamber may be prepared by activating the biasing members 16 to bias (1) the working electrode against the first aperture portion 41 of the deposition chamber frame 40; and (2) the counter electrode against second aperture portion 45 of the deposition chamber frame 40, and thereby hermetically sealing the deposition chamber (step 1040). As noted above, the counter and working electrodes (i.e., first and second electrodes 25 and 35, respectively) then form the two walls of the deposition chamber. In certain embodiments, the deposition chamber may be prepared and hermetically sealed by with pneumatic actuators 16, which may apply about 75 psi of pressure on the back of the working electrode. Step 1040 may further include providing a reference electrode 62 (e.g., a Ag/AgCl reference electrode or Pt or Au wire quasi reference electrode) to the deposition chamber at the deposition chamber frame 40.

A deposition solution may then be provided to the deposition chamber by gravity flowing the deposition solution into the deposition chamber (step 1050). Gravity flowing the deposition solution eliminates pumps and extensive circulation tubing that may ordinarily be required. A container 50 that holds the deposition solution is connected to the deposition chamber frame 40, which forms a portion of the deposition chamber, and is raised above the level of the deposition chamber to gravity flow the deposition solution into the deposition chamber.

A controller 70, which may be a potentiostat, galvanostat, or combination thereof, may then be connected to the working electrode, counter electrode, and reference electrode and a potential may be applied across the working electrode and the counter electrode (step 1060). Through the application of a potential across the working and counter electrodes in a galvanostatic or potentiostatic mode, electrochemical deposition may occur at the working electrode wherein the coating material in the deposition solution may be deposited at the working electrode. Electrochemical deposition may be carried out preferably in a potentiostatic (i.e., with controlled voltage) rather than a galvanostatic (i.e., controlled current) mode for electrochromic CPs of the invention as described, for example, in U.S. Patent Application Publication No. 2013/0120821, the entirety of which is incorporated herein by reference.

In certain embodiments of the invention, the manner in which the potential may be applied may be dependent upon the specific electrochromic CP being deposited and may be tailored thereto. For example, in the case of poly (aromatic amine) CPs, generally, a potentiostatic method with coulometric monitoring of the total charge deposited (i.e., step 1070), may be preferred. In this manner, the charge deposited per unit area may be used to control the thickness, morphology, and other parameters of the film of electrochromic CP deposited. In the case of thiophene-based CPs, generally, a repeated-potential-sweep method, starting and stopping at preferred, predetermined voltages, is preferred.

Therefore, step 1060 may include applying a linear scan applied potential, which may include scanning the applied potential from a pre-determined initial potential to a pre-determined final potential at a pre-determined scan rate. Step 1060 may, alternatively, include applying a fixed applied potential or several fixed applied potentials across the working electrode and the counter electrode. The fixed applied potential(s) may be applied until (1) a pre-determined total charge is achieved, or (2) a pre-determined total deposition time has elapsed.

Accordingly, the controller 70 may be provided to control the application of potential across the working and counter electrodes. The controller 70 may terminate or halt the electrochemical deposition process when the desired voltage, number of linear potential sweeps, total charge, or a combination of selected parameters, is achieved (step 1080).

After halting the application of potential across the working electrode and counter electrode (step 1080), the deposition solution may be removed from the deposition chamber (step 1090). To remove the deposition solution from the deposition chamber, the container 50 is lowered below the level of the deposition chamber. The fill/empty process may be automated using an actuator that may be provided to automatically raise the container or lower the container when actuated to fill or empty the vessel, respectively.

After the deposition solution is removed from the deposition chamber (step 1090), the biasing members 16 may be deactivated (e.g., releasing the pneumatic pressure at pneumatic actuators 16) and the first electrode mount 20, second electrode mount 30, and deposition chamber frame 40 may be separated to open the deposition chamber (step 1100). When the apparatus 1 is in its open configuration, the working electrode with coating material deposited thereon may be removed for further processing (step 1110).

Upon removing the working electrode with the coating material deposited thereon, the apparatus 1 may be recycled and returned to step 1020 to repeat the process in order to produce another coated or electroplated substrate. Moreover, when repeating the method 1000, the counter electrode may be cleaned before remounting the counter electrode at the second electrode mount 30 in step 1030. Alternatively, when repeating the method 1000, step 1030 may be omitted and the counter electrode need not be removed between cycles of the method.

The entire deposition process, including, for example, the steps such as loading of the substrate (i.e., working electrode), charging of the deposition solution, deposition via an applied-potential, draining of the deposition solution, and removal of the deposited substrate, is amenable to and is easily automated or semi-automated.

A number of patent and non-patent publications are cited herein in order to describe the state of the art to which this invention pertains. The entire disclosure of each of these publications is incorporated by reference herein.

While certain embodiments of the present invention have been described and/or exemplified above, various other embodiments will be apparent to those skilled in the art from the foregoing disclosure. The present invention is, therefore, not limited to the particular embodiments described and/or exemplified, but is capable of considerable variation and modification without departure from the scope and spirit of the appended claims.

Moreover, as used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general, a dimension, size, formulation, parameter, shape or other quantity or characteristic is "about" or "approximate" whether or not expressly stated to be such. It is noted that embodiments of very different sizes, shapes and dimensions may employ the described arrangements.

Furthermore, the transitional terms "comprising", "consisting essentially of" and "consisting of", when used in the appended claims, in original and amended form, define the claim scope with respect to what unrecited additional claim elements or steps, if any, are excluded from the scope of the claim(s). The term "comprising" is intended to be inclusive or open-ended and does not exclude any additional, unrecited element, method, step or material. The term "consisting of" excludes any element, step or material other than those specified in the claim and, in the latter instance, impurities ordinary associated with the specified material(s). The term "consisting essentially of" limits the scope of a claim to the specified elements, steps or material(s) and those that do not materially affect the basic and novel characteristic(s) of the claimed invention. All devices, apparatuses, and methods described herein that embody the present invention can, in alternate embodiments, be more specifically defined by any of the transitional terms "comprising," "consisting essentially of," and "consisting of."

What is claimed is:

1. An electrochemical deposition apparatus, comprising:

a. a support structure;

b. a first electrode mount connected to the support structure and comprising a working electrode;

c. a second electrode mount connected to the support structure and comprising a counter electrode; and d. a deposition chamber frame configured to receive a deposition solution and disposed proximate to the first and second electrode mounts, the deposition chamber frame comprising:

i. a first aperture portion configured to face the first electrode mount, the first aperture portion comprising a first aperture and a conductive perimeter element configured to be sealed off from the deposition solution; and ii. a second aperture portion configured to face the second electrode mount, the second aperture portion comprising a second aperture that is at least twice as large as the first aperture, wherein the working electrode is disposed proximate to the first aperture and the counter electrode is disposed proximate to the second aperture.

2. The apparatus of claim 1, comprising at least one biasing member that connects the support structure to at least one of the first electrode mount and the second electrode mount.

3. The apparatus of claim 2, wherein the at least one biasing member comprises a spring, a clamp, an actuator, or a combination thereof.

4. The apparatus of claim 2, wherein the at least one biasing member connects the support structure to the first electrode mount and comprises a pneumatic actuator.

5. The apparatus of claim 1, wherein the second aperture is larger than the first aperture.

6. The apparatus of claim 1, comprising a first electrode connected to the first electrode mount and configured to be disposed in electrical communication with the conductive perimeter element.

7. The apparatus of claim 6, wherein the first electrode comprises a material selected from the group consisting of indium-tin-oxide (ITO), poly (ethylene terephthalate) (PET), glass, and a combination thereof.

8. The apparatus of claim 6, wherein the first electrode comprises a conductive sheet.

9. The apparatus of claim 1, wherein the conductive perimeter element comprises at least one electrode contact.

10. The apparatus of claim 9, wherein the at least one electrode contact comprises a plurality of electrode contacts.

11. The apparatus of claim 10, wherein the plurality of electrode contacts comprises a plurality of spring-loaded contact pins.

12. The apparatus of claim 1, comprising a second electrode connected to the second electrode mount.

13. The apparatus of claim 12, wherein the second electrode comprises one or more of graphite, gold, and platinum.

14. The apparatus of claim 12, wherein the second electrode comprises a conductive sheet.

15. The apparatus of claim 1, comprising a controller in electrical communication with the conductive perimeter element.

16. The apparatus of claim 1, comprising a controller in electrical communication with the conductive perimeter element and the counter electrode.

17. The apparatus of claim 1, comprising a reference electrode configured to be disposed within the deposition chamber frame.

18. The apparatus of claim 17, wherein the reference electrode comprises one or more of an Ag/AgCl reference electrode, a Pt wire quasi-reference electrode, and an Au wire quasi-reference electrode.

19. The apparatus of claim 1, comprising a container in fluid communication with the deposition chamber frame; wherein the container is configured to contain a deposition solution that comprises a coating material.

20. An electrochemical deposition apparatus comprising an electroplating vessel, the apparatus comprising:

a. a support structure;

b. a frame disposed within the support structure and comprising a cavity configured to receive a deposition solution, the cavity comprising:

i. a first aperture portion comprising a first aperture; and ii. a second aperture portion comprising a second aperture, wherein the second aperture is at least twice as large as the first aperture;

c. a working electrode disposed proximate to the first aperture, wherein the working electrode comprises a conductive perimeter element configured to be sealed off from the deposition solution; and d. a counter electrode disposed proximate to the second aperture;

wherein the frame, the working electrode, and the counter electrode combine to form the electroplating vessel.

21. The apparatus of claim 20, wherein the cavity comprises a telescoped cavity, a tapered cavity, or a combination thereof.

22. The apparatus of claim 20, comprising a plurality of guides that are configured to align the frame, the working electrode, and the counter electrode.

* * * * *